US011823857B2

(12) United States Patent
Jin et al.

(10) Patent No.: US 11,823,857 B2
(45) Date of Patent: Nov. 21, 2023

(54) FUSE MODULE WITH CLAMPED FUSE INSTALLATION

(71) Applicant: Suzhou Littelfuse OVS Co., Ltd., Suzhou (CN)

(72) Inventors: Edward Jin, Suzhou (CN); Vector Li, Suzhou (CN); Zhibo Liu, Suzhou (CN)

(73) Assignee: Suzhou Littelfuse OVS Co., Ltd., Suzhou (CN)

( * ) Notice: Subject to any disclaimer, the term of this patent is extended or adjusted under 35 U.S.C. 154(b) by 0 days.

(21) Appl. No.: 17/958,770

(22) Filed: Oct. 3, 2022

(65) Prior Publication Data

US 2023/0162940 A1 May 25, 2023

(30) Foreign Application Priority Data

Nov. 19, 2021 (CN) ..... 202111391543.7

(51) Int. Cl.

| | |
|---|---|
| ***H01H 85/22*** | (2006.01) |
| ***H01H 15/22*** | (2006.01) |
| ***H01H 85/055*** | (2006.01) |
| ***H01H 85/165*** | (2006.01) |
| ***H01H 85/20*** | (2006.01) |

(52) U.S. Cl.

CPC ..... *H01H 15/22* (2013.01); *H01H 85/055* (2013.01); *H01H 85/165* (2013.01); *H01H 85/2045* (2013.01); *H01H 2085/209* (2013.01)

(58) Field of Classification Search

CPC .... H01H 85/22; H01H 85/055; H01H 85/165; H01H 85/2045; H01H 85/143; H01H 85/205; H01H 2085/025; H01H 2085/207–209

See application file for complete search history.

(56) References Cited

U.S. PATENT DOCUMENTS 3,383,646 A * 5/1968 Otto ..... H01R 11/286 439/760

9,705,299 B1 7/2017 Maurer (Continued)

FOREIGN PATENT DOCUMENTS

EP 2993681 A1 3/2016

OTHER PUBLICATIONS

European Search Report and Written Opinion for the European Application No. EP22202505, dated Mar. 16, 2023, 7 pages.

*Primary Examiner* — Jacob R Crum

(74) *Attorney, Agent, or Firm* — KDW Firm PLLC

(57) ABSTRACT

A fuse module including a housing, a busbar disposed within the housing adjacent an interior surface of a rear wall of the housing, a terminal extending through a front wall of the housing and having a fuse coupling portion disposed within the housing adjacent an interior surface of a front wall of the housing and a conductor coupling portion protruding from an exterior surface of the front wall of the housing, and a movable pushrod extending through the rear wall of the housing and having a head portion disposed adjacent a rigid portion of the busbar for moving the rigid portion of the busbar between a retracted position, the rigid portion of the busbar located near the interior surface of the rear wall, and an extended position wherein the rigid portion of the busbar is located further from the interior surface of the rear wall relative to the retracted position.

10 Claims, 6 Drawing Sheets

(56) References Cited

U.S. PATENT DOCUMENTS

| | | | | |
|---|---|---|---|---|
| 2001/0053061 | A1* | 12/2001 | Yu | H01H 73/30<br>361/695 |
| 2004/0008503 | A1* | 1/2004 | Higuchi | H01H 85/044<br>361/833 |
| 2004/0214458 | A1 | 10/2004 | Maebashi | |
| 2010/0039789 | A1* | 2/2010 | Mason | H02B 11/26<br>361/833 |
| 2018/0301310 | A1* | 10/2018 | Allcorn | H01H 85/205 |
| 2019/0123495 | A1* | 4/2019 | Darr | H01R 27/02 |
| 2019/0228940 | A1 | 7/2019 | Bommersheim | |
| 2021/0391658 | A1* | 12/2021 | Wu | H01R 9/2408 |

* cited by examiner

FUSE MODULE WITH CLAMPED FUSE INSTALLATION

FIELD OF THE DISCLOSURE

The disclosure relates generally to the field of circuit protection devices and relates more particularly to a fuse module with fuses that can be easily clamped and unclamped for convenient installation and removal.

BACKGROUND OF THE DISCLOSURE

In the global automotive market there has been a trend toward implementing so-called "pre-fuse boxes" that are disposed within automobile engine compartments and connected to automobile battery terminals. The primary purpose of a pre-fuse box in an automobile is to prevent electrical damage to the automobile battery and connected loads that may otherwise result from short-circuiting in high-current-conducting wires, such as may occur in the event of a collision.

Existing pre-fuse boxes are typically quite large and require a great deal of space within an automobile engine compartment where space is already very limited. Additionally, fuses within existing pre-fuse boxes are typically secured using conventional mechanical fasteners (e.g., nuts, bolts, etc.) which contribute to the size of a pre-fuse box and can make the installation and removal of fuses cumbersome and time-consuming.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A fuse module in accordance with an exemplary embodiment of the present disclosure may include a housing formed of an electrically insulating material, a busbar disposed within the housing adjacent an interior surface of a rear wall of the housing, a terminal extending through a front wall of the housing, the terminal having a fuse coupling portion disposed within the housing adjacent an interior surface of a front wall of the housing and a conductor coupling portion protruding from an exterior surface of the front wall of the housing, and a movable pushrod extending through the rear wall of the housing and having a head portion disposed adjacent a rigid portion of the busbar for moving the rigid portion of the busbar between a retracted position, wherein the rigid portion of the busbar is located near the interior surface of the rear wall, and an extended position wherein the rigid portion of the busbar is located further from the interior surface of the rear wall relative to the retracted position.

A fuse module in accordance with another exemplary embodiment of the present disclosure may include a housing formed of an electrically insulating material, a busbar disposed within the housing adjacent an interior surface of a rear wall of the housing, a terminal extending through a front wall of the housing, the terminal having a fuse coupling portion disposed within the housing adjacent an interior surface of a front wall of the housing and a conductor coupling portion protruding from an exterior surface of the front wall of the housing, and a fuse disposed within the housing, The fuse may include a mounting block formed of an electrically insulating material, and a fuse plate having a rear portion disposed on a rear surface of the mounting block, in a confronting relationship with the rigid portion of the busbar, a front portion disposed on a front surface of the mounting block, in a confronting relationship with fuse coupling portion of the terminal, and a fusible element disposed adjacent a top surface of the mounting block and connecting the rear portion of the fuse plate to the front portion of the fuse plate. The fuse module may further include a movable pushrod extending through the rear wall of the housing and having a head portion disposed adjacent a rigid portion of the busbar for moving the rigid portion of the busbar between a retracted position, wherein the rigid portion of the busbar does not engage the rear portion of the fuse plate, and an extended position wherein the rigid portion of the busbar engages the rear portion of the fuse plate.

DETAILED DESCRIPTION

A fuse module in accordance with the present disclosure will now be described more fully with reference to the accompanying drawings, in which preferred embodiments of the fuse module are presented. It will be understood, however, that the fuse module may be embodied in many different forms and should not be construed as being limited to the embodiments set forth herein. Rather, these embodiments are provided so that this disclosure will convey certain exemplary aspects of the fuse module to those skilled in the art.

Figure 1A:
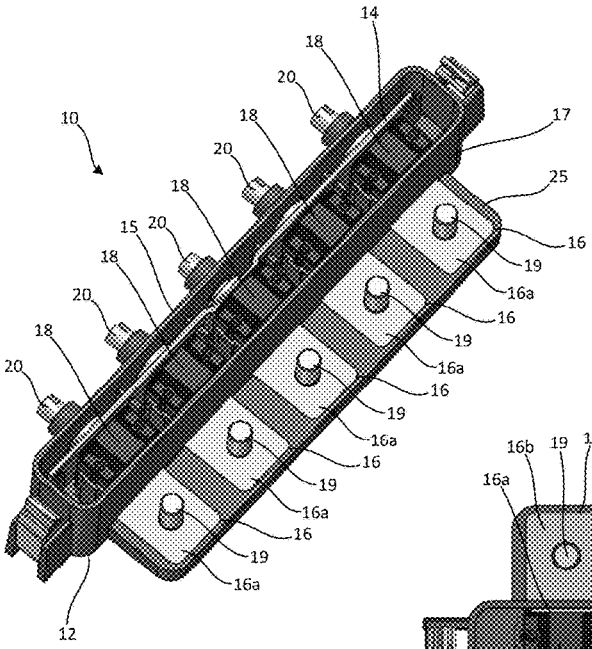
FIG. 1A is a perspective view illustrating a fuse module in accordance with an exemplary embodiment of the present disclosure.
Figure 1B:
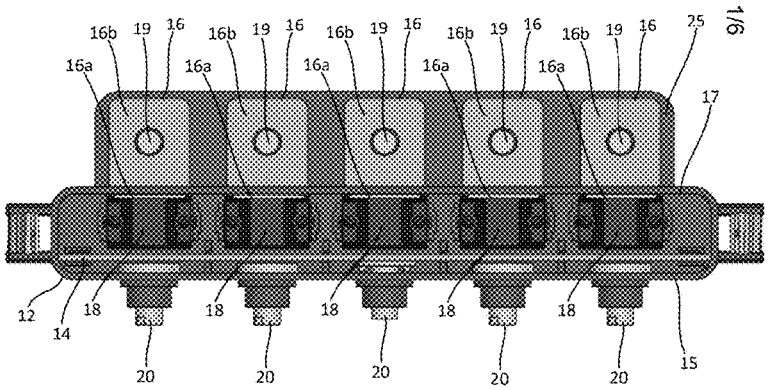
FIG. 1B is a top view illustrating the fuse module shown in FIG. 1A.

Referring to FIGS. 1A and 1B, a perspective view and a top view illustrating a fuse module 10 in accordance with an exemplary, non-limiting embodiment of the present disclosure are shown. For the sake of convenience and clarity, terms such as "front," "rear," "top," "bottom," "side," "above," and "below" may be used herein to describe the relative placement and orientation of various components of the fuse module 10, all with respect to the geometry and orientation of the fuse module 10 as it appears in FIGS. 1A and 1B. Said terminology will include the words specifically mentioned, derivatives thereof, and words of similar import.

The fuse module 10 may generally include an electrically insulating housing 12, an electrically conductive busbar 14 disposed within the housing 12 adjacent a rear wall 15 of the housing 12, a plurality of electrically conductive terminals 16 extending through a front wall 17 of the housing 12, a plurality of fuses 18 disposed within the housing 12 between busbar 14 and respective terminals 16, and a plurality of pushrods 20 extending through the rear wall 15 of the housing 12. Each of the terminals 16 may include a conductor coupling portion 16*a* disposed on a shelf or flange 25 projecting from an exterior surface of the front wall 17 of the housing 12, and a fuse coupling portion 16*b* disposed within the housing 12 immediately adjacent, and flatly abutting, an interior surface of the front wall 17. Threaded mounting posts 19 may extend from the flange 25 through each of the conductor coupling portions 16*a* for facilitating connections to electrical conductors as further described below. The terminals 16 may be generally L-shaped (when viewed from the side) so that conductor coupling portion 16*a* and fuse coupling portion 16*b* of each terminal 16 are oriented perpendicular to one another. The present disclosure is not limited in this regard. The fuse module 10 may further include a cover (not shown) that may be removably coupled to the open top of the housing 12 for protecting components of the fuse module 10 from external elements. Notably, the term "fuse module" as used herein may refer to embodiments of the present disclosure with or without any fuses 18 disposed within the housing 12 between the busbar 14 and the terminals 16. That is, all of the fuses 18 may be removed from the housing 12, and the remaining structure may still be referred to as a "fuse module."

Figure 2A:
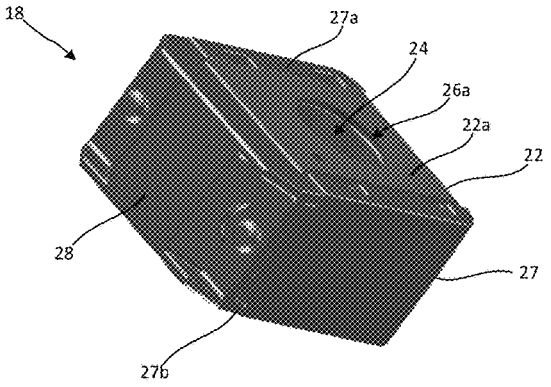
FIGS. 2A-2C are a series of perspective views illustrating a fuse of the fuse module shown in FIGS. 1A and 1B.
Figure 2B:
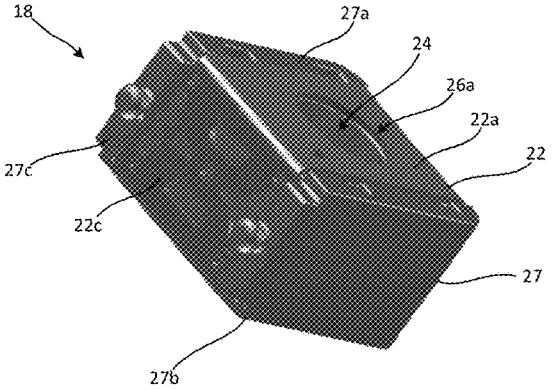
Figure 2C:
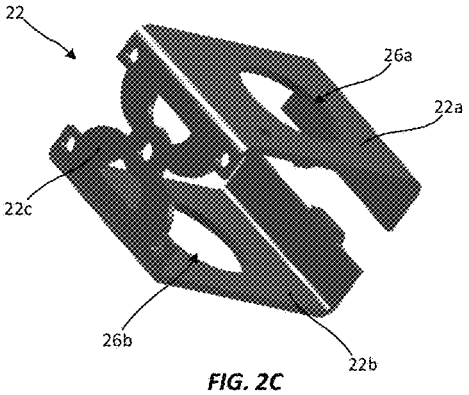

Referring to FIGS. 2A-2C, several views illustrating one of the fuses 18 and its components are shown. It will be understood that all of the fuses 18 shown in FIGS. 1A and 1B are substantially identical to the fuse 18 shown in FIGS. 2A-2C, and that the illustrations of the fuse 18 provided in FIGS. 2A-2C, and the corresponding description of the fuse 18 provided below, shall apply to all of the fuses 18 shown in FIGS. 1A and 1B.

In various embodiments the fuse 18 may be, or may be similar to, a commercially available fuse manufactured by LITTELFUSE, INC and sold under the name ZCASE. The present disclosure is not limited in this regard. The fuse 18 may include a mounting block 27 formed of an electrically insulating material, and an electrically conductive fuse plate 22 that extends around several surfaces of the mounting block 27. Particularly, the fuse plate 22 (which is shown in isolation in FIG. 2C for clarity) may include a rear portion 22*a* disposed on a rear surface 27*a* of the mounting block 27, a front portion 22*b* disposed on a front surface 27*b* of the mounting block 27, opposite the rear surface 27*a*, and a fusible element 22*c* disposed on or adjacent a top surface 27*c* of the mounting block 27 and connecting the rear portion 22*a* to the front portion 22*b*. The mounting block 27 may include a through hole 24 extending between and through the rear surface 27*a* and the front surface 27*b*. The rear and front portions 22*a*, 22*b* of the fuse plate 22 may include respective first and second through holes 26*a*, 26*b* that are aligned with the through hole 24 of the mounting block 27. The through holes 24, 26*a*, and 26*b* are standard features of the commercially available ZCASE fuse sold by LITTELFUSE but are not relevant or necessary for the implementation of the fuse 18 within the fuse module 10 of the present disclosure. The through holes 24, 26*a*, and 26*b* may therefore be omitted from the fuse 18 without departing from the scope of the present disclosure. The fuse 18 may further include an insulating cover 28 (shown in FIG. 2A and omitted in FIG. 2B) that fits over the fusible element 22*c* and attaches to the top surface 27*c* of the mounting block 27 (e.g., via snap fit, mechanical fasteners, etc.).

The fusible element 22*a* may be configured to melt, disintegrate, or otherwise open if current flowing through fuse plate 22 exceeds a predetermined threshold, or "current rating," of the fuse 18. In various examples, the fusible element 22*c* may include perforations, slots, thinned or narrowed segments, and/or various other features for making the fusible element 22*c* more susceptible to melting or opening than other portions of the fuse plate 22. As shown in FIG. 2C, the fusible element 22*c* may have a generally X-shaped configuration. The present disclosure is not limited in this regard.

Figure 3A:
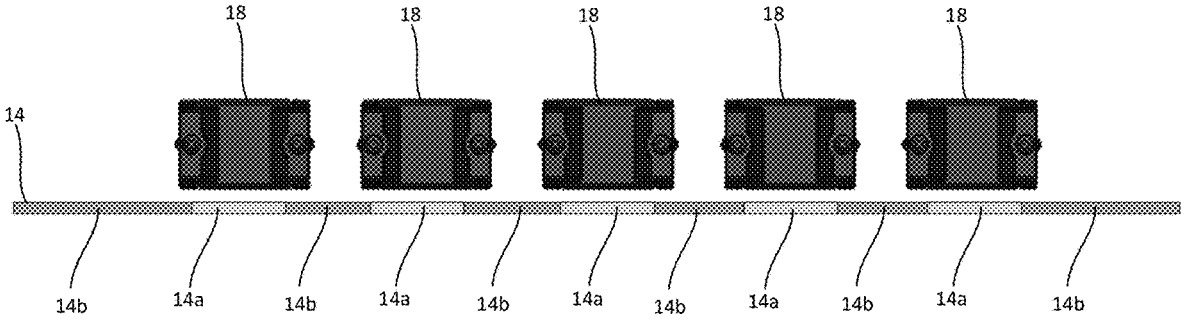
FIGS. 3A and 3B are top views illustrating fuses and a busbar of the fuse module shown in FIGS. 1A and 1B.
Figure 3B:
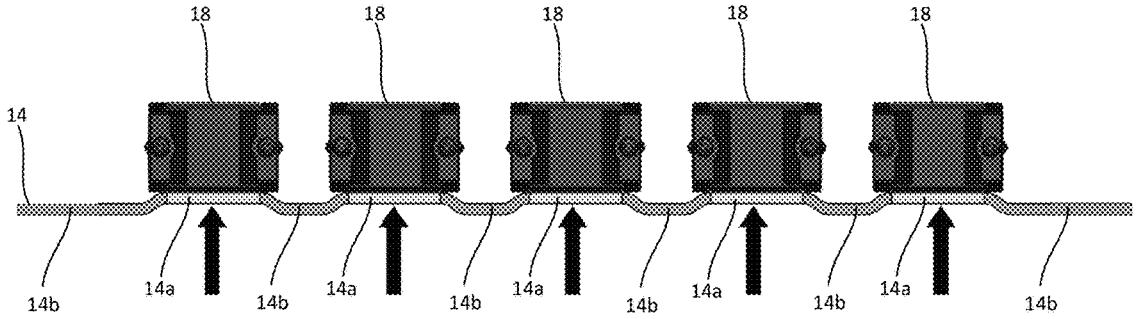

Referring to FIGS. 3A and 3B, top views illustrating the busbar 14 and fuses 18 of the fuse module 10 in isolation are shown. The busbar 14 may include a plurality of rigid portions 14*a* and a plurality of flexible portions 14*b*, wherein the flexible portions 14*b* extend between the rigid portions 14*a*, and wherein the rigid portions 14*a* may be aligned with the fuses 18. In various embodiments, the busbar 14 may be formed of a plurality of electrically conductive foils (e.g., copper foils) that are stacked together, wherein certain portions of the stacked foils are welded together (via molecular diffusion welding, for example) to define the rigid portions 14*a*, and wherein the other portions of the stacked foils are not welded together to define the flexible portions 14*b*. The flexible portions 14*b* may have a spring-like quality and may be biased toward a relaxed, planar state, wherein the rigid portions 14*a* are generally coplanar with the flexible portions 14*b* as shown in FIG. 3A. However, when a normal force is applied to the rigid portions 14*a* as indicated by the arrows in FIG. 3B the flexible portions 14*b* may flex or bend, thereby allowing the rigid portions 14*a* to be moved into contact with the fuses 18 as further described below. When the normal force is removed, the flexible portions 14*b* may return to their relaxed, planar states shown in FIG. 3A.

Figure 4A:
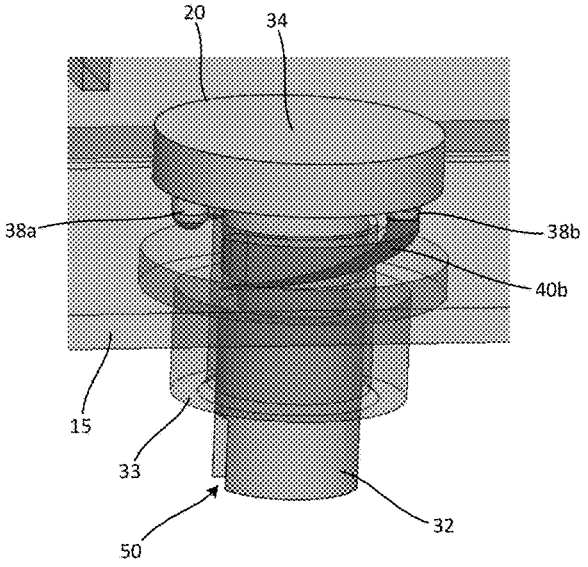
FIGS. 4A and 4B are detail views illustrating a pushrod and a surrounding portion of a rear wall of a housing of the fuse module shown in FIGS. 1A and 1B.
Figure 4B:
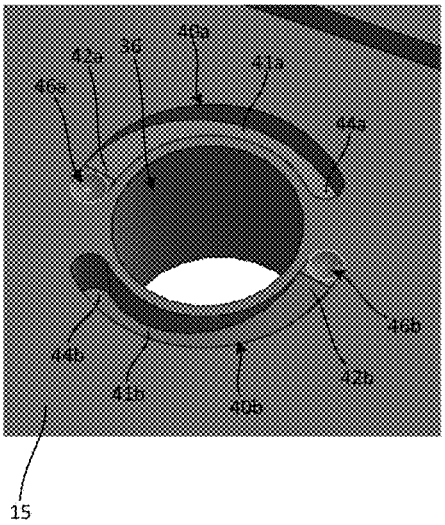

Referring to FIGS. 4A and 4B, detail views illustrating one of the pushrods 20 and a surrounding portion of the rear wall 15 of the housing 12 are shown (the pushrod 20 is omitted from FIG. 4B and only an interior surface of the surrounding portion of the rear wall 15 is shown). It will be understood that all of the pushrods 20 and the corresponding, surrounding portions of the rear wall 15 shown in FIGS. 1A and 1B are substantially identical to the pushrod 20 and surrounding portion of the rear wall 15 shown in FIGS. 4A and 4B, and that the illustrations of the pushrod 20 and surrounding portion of the rear wall 15 provided in FIGS. 4A and 4B, and the corresponding description of the same provided below, shall apply to all of the pushrods 20 and surrounding portions of the rear wall 15 shown in FIGS. 1A and 1B.

As shown in FIG. 4A, the pushrod 20 may have a cylindrical shaft portion 32 extending through an aperture 36 in the rear wall 15 of the housing 12, and a cylindrical head portion 34 disposed within the housing 12. The head portion 34 may have a diameter that is larger than a diameter of the shaft portion 32 and that is too large to fit through the aperture 36. In various embodiments, the shaft portion 32 may extend through a tubular neck 33 that extends from a rear surface of the rear wall 15, and an O-ring 35 (see FIG. 5A) formed of a resilient material (e.g., rubber, plastic, etc.) may disposed radially intermediate an exterior surface of the shaft portion 32 and an interior surface of the neck 33 to form a seal therebetween. The present disclosure is not limited in this regard.

The head portion 34 may have a pair of diametrically opposed, rounded detents 38*a*, 38*b* extending from a rear surface thereof. Referring to FIG. 4B, the interior surface of the rear wall 15 may have a pair of diametrically opposed, curvilinear grooves 40*a*, 40*b* formed therein surrounding the aperture 36. The curvilinear grooves 40*a*, 40*b* may extend along an imaginary circle having a diameter that is substantially equal to a distance between the rounded detents 38*a*, 38*b*. The curvilinear grooves 40*a*, 40*b* may have floors 41*a*, 41*b* that are sloped such that each of the curvilinear grooves 40*a*, 40*b* gradually deepens in the clockwise direction from a shallow end 42*a*, 42*b* that is nearly coplanar with the interior surface of the rear wall 15 to a deep end 44*a*, 44*b* that is recessed from the interior surface of the rear wall 15 (e.g., having a depth equal to or greater than a height of the rounded detents 38*a*, 38*b*). Dimples 46*a*, 46*b* may be formed in the shallow ends 42*a*, 42*b* of the curvilinear grooves 40*a*, 40*b*, respectively. The dimples 46*a*, 46*b* made have a size and a shape adapted to accommodate tips of the detents 38*a*, 38*b* as further described below.

The pushrod 20 may be movable between a retracted position and an extended position relative to the interior surface of the rear wall 15. In the retracted position, the detents 38*a*, 38*b* may be disposed within the deep ends 44*a*, 44*b* of the curvilinear grooves 40*a*, 40*b*, respectively, and the head portion 34 of the pushrod 20 may be disposed in flat abutment with the interior surface of the rear wall 15. To move the pushrod 20 from the retracted position to the extended position, the shaft portion 32 of the pushrod 20 may be rotated in the clockwise direction, causing the detents 38*a*, 38*b* to ride along the sloped floors 41*a*, 41*b* of the curvilinear grooves 40*a*, 40*b* and move from the deep ends 44*a*, 44*b* to the shallow ends 42*a*, 42*b*, where the detents 38*a*, 38*b* may be received by the dimples 46*a*, 46*b*, respectively. The pushrod 20 may thus be placed in the extended position (as shown in FIG. 4A), wherein the head portion 34 of the pushrod 20 may be spaced apart from the interior surface of the rear wall 15. The engagement between the detents 38*a*, 38*b* and the dimples 46*a*, 46*b* may hold or lock the pushrod 20 in the extended position by preventing the detents 38*a*, 38*b* from sliding back down the sloped floors 41*a*, 41*b* toward the deep ends 44*a*, 44*b* of the curvilinear grooves 40*a*, 40*b*. To move the pushrod 20 back to the retracted position, the shaft portion 32 of the pushrod 20 may be rotated in the counterclockwise direction with sufficient force to unseat the detents 38*a*, 38*b* from the grooves 40*a*, 40*b* and rotate the detents 38*a*, 38*b* back to the deep ends 44*a*, 44*b* of the curvilinear grooves 40*a*, 40*b*. In various embodiments, a rear end of the shaft portion 32 of the pushrod 20 may be adapted to receive or accommodate a tool to facilitate convenient, manual rotation of the pushrod 20. For example, the rear end of the shaft portion 32 may have a slot 50 formed therein for accommodating a flathead screwdriver. The present disclosure is not limited in this regard.

Figure 5A:
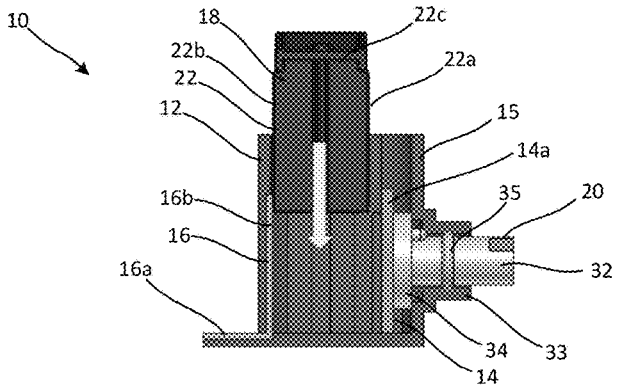
FIGS. 5A-5D are a series of cross-sectional views illustrating a fuse of the fuse module shown in FIGS. 1A and 1B being installed and removed.
Figure 5B:
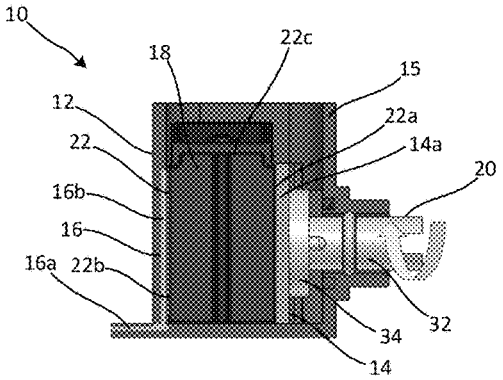

Referring to FIGS. 5A-5D, a series of cross-sectional views illustrating the installation and removal of one of the above-described fuses 18 is provided. As shown in FIG. 5A, the fuse 18 may be inserted into the housing 12 between a rigid portion 14*a* of the busbar 14 and a fuse coupling portion 16*b* of one of the terminals 16, with the rear portion 22*b* of the fuse plate 22 confronting, and parallel with, the rigid portion 14*a* of the busbar 14, and with the front portion 22*b* of the fuse plate 22 confronting, and parallel with, the fuse coupling portion 16*b* of the terminal 16. After the fuse 18 has been fully inserted into the housing 12, the shaft portion 32 of the pushrod 20 may be rotated in the clockwise direction to move the pushrod 20 from the retracted position to the extended position as shown in FIG. 5B. When the pushrod 20 is extended, the pushrod 20 may push the rigid portion 14*a* of the busbar 14 into engagement with the rear portion 22*b* of the fuse plate 22 and may firmly clamp the fuse 18 between the rigid portion 14*a* and the fuse coupling portion 16*b* of the terminal 16. An electrical pathway is thus established that extends through the busbar 14, the rear portion 22*b* of the fuse plate 22, the fusible element 22*c* of the fuse plate 22, the front portion 22*b* of the fuse plate 22, the fuse coupling portion 16*b* of the terminal 16, and the conductor coupling portion 16*a* of the terminal 16. As described above, the movement of the rigid portion 14*a* of the busbar 14 is facilitated by the flexure of the surrounding flexible portions 14*b* of the busbar 14 (see FIG. 3B).

Figure 5C:
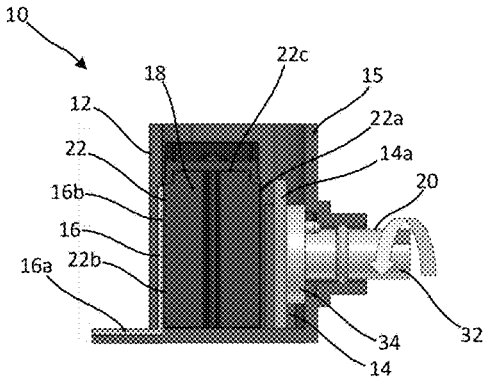
Figure 5D:
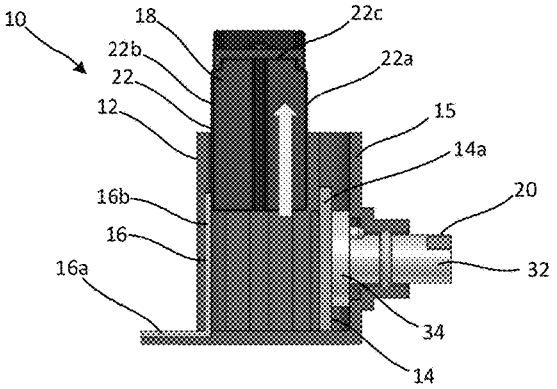

To remove the fuse 18 from the housing 12, the shaft portion 32 of the pushrod 20 may be rotated in the counterclockwise direction to move the pushrod 20 from the extended position to the retracted position as shown in FIG. 5C. The fuse 18 is thereby unclamped and the electrical connection between the rigid portion 14*a* of the busbar 14 and the rear portion 22*b* of the fuse plate 22 is broken. The fuse 18 may thereafter be pulled or lifted out of the housing 12 without restriction as shown in FIG. 5D.

Figure 6:
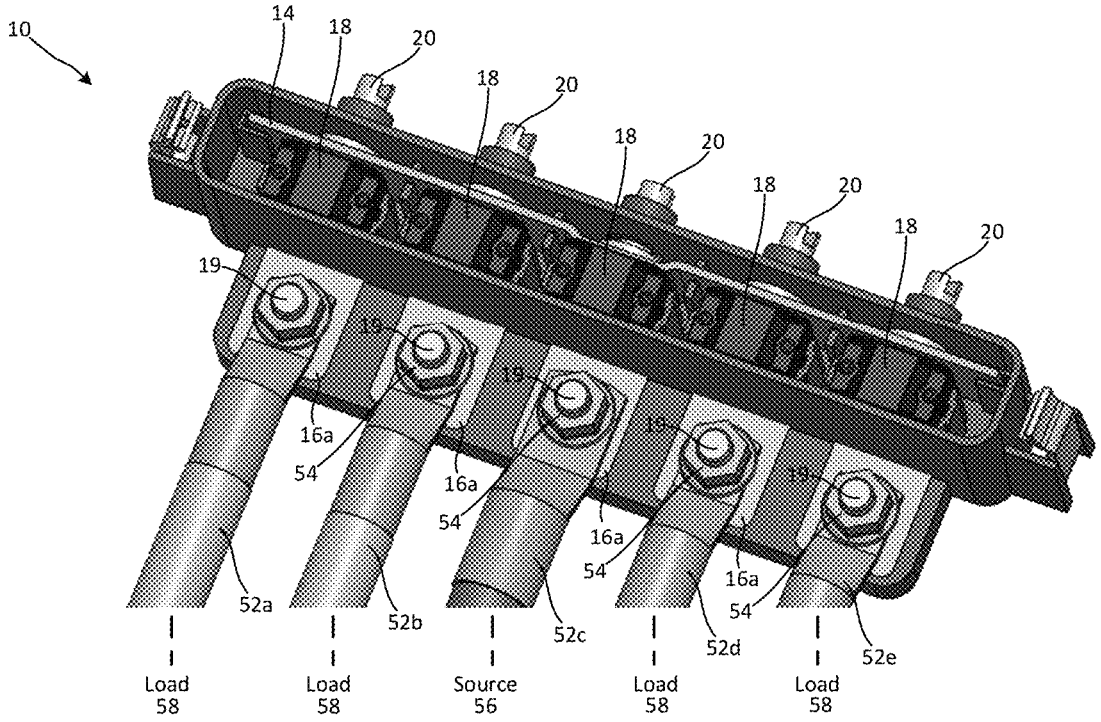
FIG. 6 is a perspective view illustrating an exemplary implementation of the fuse module shown in FIGS. 1A and 1B.

Referring to FIG. 6, an exemplary implementation of the fuse module 10 is shown. Ring terminals of electrical cables 52*a-e* may be fitted onto the threaded mounting posts 19 and may be secured the against the conductor coupling portions 16*a* of the terminals 16 with respective nuts 54 that may be tightened onto the mounting posts 19. The electrical cable 52*c* may be coupled to a source of electrical power 56 (e.g., an automobile battery), and the other electrical cables 52*a, b, d*, and *e* may be coupled to various electrical loads 58 (e.g., electrical systems within an automobile). Thus, when all of the pushrods 20 are moved to their extended positions, all of the electrical cables 52*a-e* may be placed in electrical communication with the busbar 14. The fuse module 10 thereby provides fused electrical connections between the source of electrical power 56 and each of the loads 58. Upon the occurrence of an overcurrent condition between the source of electrical power 56 and one or more of the loads 58, the fusible element 22*c* in one or more of the fuses 18 may melt or otherwise separate, thereby arresting the flow of current therethrough to prevent or mitigate damage to connected electrical components. The blown fuses 20 may then be quickly and conveniently removed and replaced in the manner described above without requiring the removal or reinstallation of any removable fasteners (e.g., nuts, bolts, screws, etc.).

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A fuse module comprising:

a housing formed of an electrically insulating material;

a busbar disposed within the housing adjacent an interior surface of a rear wall of the housing;

a terminal extending through a front wall of the housing, the terminal having a fuse coupling portion disposed within the housing adjacent an interior surface of a front wall of the housing and a conductor coupling portion protruding from an exterior surface of the front wall of the housing; and a movable pushrod extending through the rear wall of the housing and having a head portion disposed adjacent a rigid portion of the busbar for moving the rigid portion of the busbar between a retracted position, wherein the rigid portion of the busbar is located near the interior surface of the rear wall, and an extended position wherein the rigid portion of the busbar is located further from the interior surface of the rear wall relative to the retracted position.

2. The fuse module of claim 1, wherein the busbar and the fuse coupling portion of the terminal are parallel to one another.

3. The fuse module of claim 1, wherein the busbar comprises a plurality of rigid portions and a plurality of flexible portions extending between the rigid portions.

4. The fuse module of claim 3, wherein the busbar is formed of a stack of metallic foils, wherein the metallic foils are welded together to define the rigid portions of the busbar, and wherein the metallic foils are not welded together to define the flexible portions of the busbar.

5. The fuse module of claim 1, wherein the conductor coupling portion of the terminal is disposed on a flange projecting from an exterior surface of the front wall of the housing.

6. The fuse module of claim 5, further comprising a threaded mounting post extending from the flange through the conductor coupling portion.

7. The fuse module of claim 1, wherein the movable pushrod includes a shaft portion extending from the head portion through the rear wall of the housing.

8. The fuse module of claim 7, wherein the shaft portion extends through a tubular neck extending from the rear wall of the housing, and wherein an O-ring is disposed radially intermediate an exterior surface of the shaft portion and an interior surface of the tubular neck to form a seal therebetween.

9. The fuse module of claim 7, wherein the interior surface of the rear wall of the housing includes a pair of curvilinear grooves formed therein surrounding the shaft portion of the movable pushrod, the curvilinear grooves having sloped floors and being configured to accommodate a pair of detents extending from a rear surface of the head portion of the movable pushrod.

10. The fuse module of claim 9, wherein rotation of the movable pushrod in a first direction causes the head portion of the movable pushrod to move away from the rear wall and to move the rigid portion of the busbar from the retracted position to the extended position, and wherein rotation of the movable pushrod in a second direction opposite the first direction causes the head portion of the movable pushrod to move toward the rear wall and to move the rigid portion of the busbar from the extended position to the retracted position.

* * * * *